United States Patent [19]

Casull

[11] 4,228,608

[45] Oct. 21, 1980

[54] CYLINDER LOCKING MECHANISM FOR SMALL REVOLVERS

[76] Inventor: Richard J. Casull, P.O. Box 276, Freedom, Wyo. 83120

[21] Appl. No.: 961,980

[22] Filed: Nov. 20, 1978

[51] Int. Cl.[3] ..... F41C 1/00

[52] U.S. Cl. ..... 42/67

[58] Field of Search ..... 42/67

[56] References Cited

U.S. PATENT DOCUMENTS

| | | | |
|---|---|---|---|
| 2,733,529 | 2/1956 | Ruger | 42/67 |
| 3,187,454 | 6/1965 | Geber | 42/67 |
| 3,831,305 | 8/1974 | Casull | 42/67 |
| 4,024,663 | 5/1977 | Baker | 42/67 |
| 4,126,953 | 11/1978 | Casull | 42/67 |

*Primary Examiner*—Charles T. Jordan

*Attorney, Agent, or Firm*—Criddle & Western

[57] ABSTRACT

Improved cylinder locking means for a small, single action revolver which is positioned entirely within the body of the revolver and operates with the hammer and hand to release the cylinder during cocking of the hammer and to lock the cylinder against turning during firing of the revolver and when the hammer is in a forward position. A spring biased latch member is pivotally connected between its ends to the frame of the revolver so that one end of the latch is positioned adjacent to the lower side of the cylinder and is adapted to make releasable engagement with the cylinder. The other end of the latch is positioned close to one of the sides of the hammer. An actuating member projects from the hammer or hand and is adapted to strike the underside of the end of the latch during the initial cocking movement of the hammer and pivot the latch to release the cylinder for rotation. As the hammer approaches the fully cocked position, the actuating member escapes beyond the end of the latch member, so that the latch member moves into engagement with the cylinder and locks the cylinder in proper firing position. As the revolver is fired, the actuating member is biased to slide past the latch to again be in position to strike the underside of the latch during a succeeding cocking movement of the hammer.

8 Claims, 7 Drawing Figures

FIG. 1
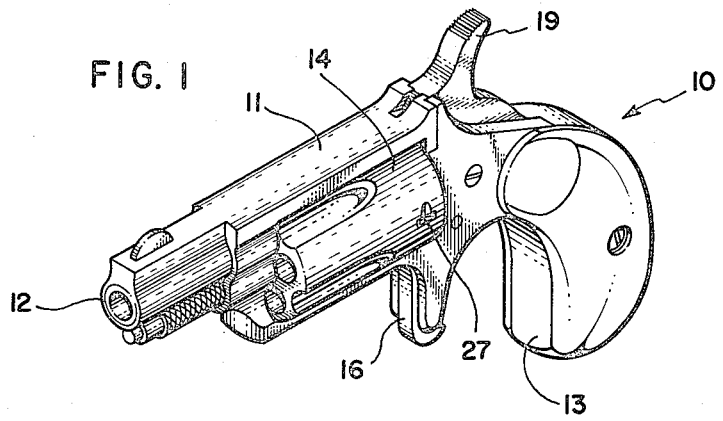
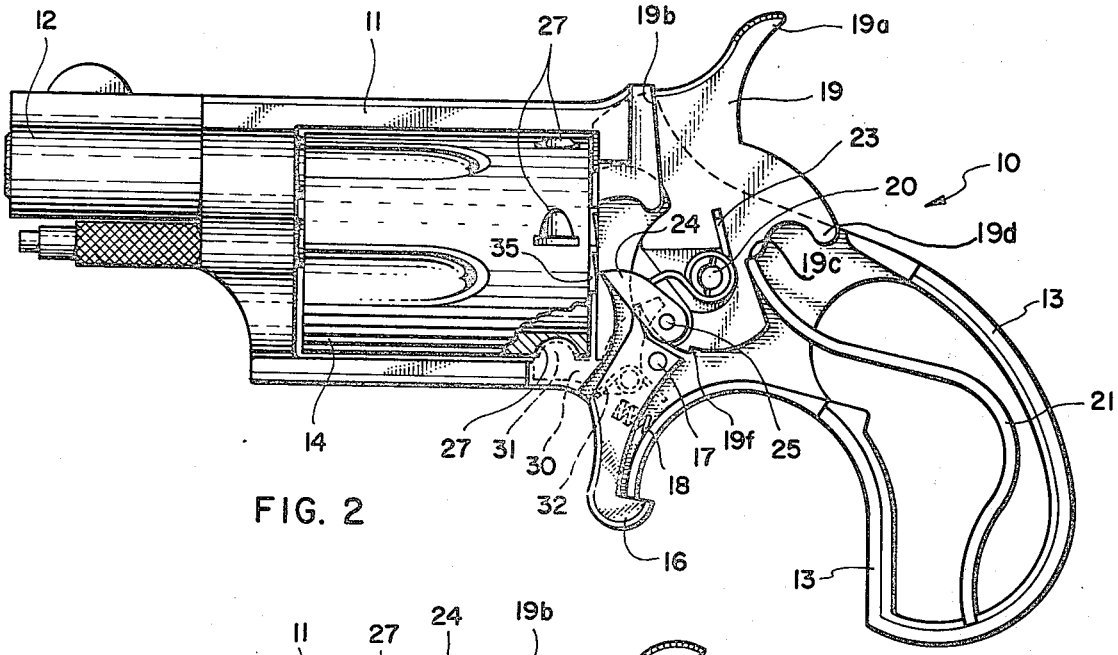
FIG. 2
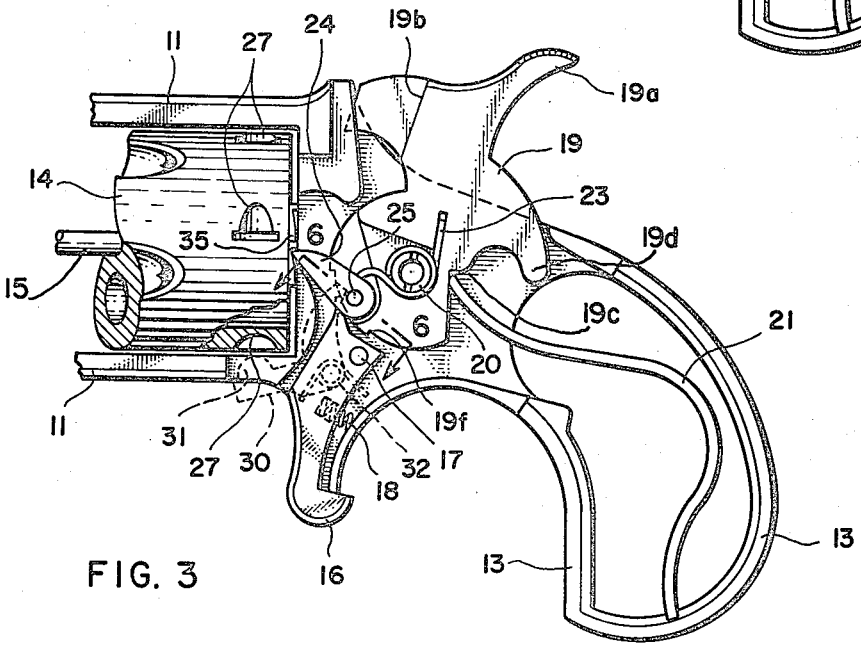
FIG. 3

CYLINDER LOCKING MECHANISM FOR SMALL REVOLVERS

BACKGROUND OF THE INVENTION

Field

The invention relates to small, single action revolvers and more particularly to improved means for locking and releasing the rotatable cylinders of such revolvers.

State of the Art

Revolvers of various sizes and shapes are well known in the art. In almost all these revolvers means are provided for sequentially rotating and locking the rotatable cylinder in which cartridges are placed each time the hammer is cocked so that a loaded cartridge is properly positioned for subsequent firing of the revolver. With conventional, large size hand guns, the cylinder lock can be rather easily accommodated and various cams or levers can be used to move the cylinder lock out of and back into engagement with the cylinder in proper sequence during cocking of the hammer. An example of a cylinder lock for such conventional revolvers is described in U.S. Pat. No. 2,733,529, issued to William B. Ruger on Feb. 6, 1956.

In smaller sized revolvers it is much more difficult to properly position all the actuating components, and the size of the components must often be greatly reduced. The reduced size of the components often results in a weakening thereof which may cause early failure of the revolver. A cylinder lock for such small revolvers is disclosed in U.S. Pat. No. 4,024,663 issued to Wayne B. Baker on May 24, 1977. The cylinder lock described in U.S. Pat. No. 4,024,663 comprises an elongate bar extending from the underside of the cylinder, beyong the upper end of the trigger to a pivotal connection to the frame handle of the revolver. The bar has a curved spring connected to the handle end thereof, with the other end of the spring in engagement with the handle frame. The bar has an offset hump intermediate its length to allow it to clear the pivot pin of the trigger, and a camming notch is formed in the bar near the hump, with the notch extending deeply into the bar.

OBJECTIVES

The principal objective of the present invention is to provide an improved compact cylinder locking means which is mounted substantially between the cylinder and the trigger of the revolver and does not extend into the handle of the revolver. Another objective is to provide a simplified cylinder locking mechanism that can be used in very small sized revolvers and is of inherently durable construction.

SUMMARY OF THE INVENTION

The above objectives are achieved in accordance with the present invention by providing a spring biased, rocker latch member which is pivotally connected at a position between its ends to the side cover plate of the revolver. The latch member includes a locking lug on one end thereof to engage notches provided therefor in usual fashion on the outside of the cylinder. The other end portion of the latch member is positioned close to one of the sides of the hammer.

Spring means acts upon the latch member biasing the locking lug on the one end of the latch member into releasable engagement with notches on the outside of the cylinder. An actuating member projecting outwardly from the hammer strikes the underside of the other end portion of the latch member and pivots the latch member to release the locking lug from the cylinder notches during the initial cocking movement of the hammer. The actuating member remains in contact with the latch member, thereby retaining the latch member out of engagement with the notches in the cylinder during the intermediate cocking movement of the hammer, so that the hand or pawl, which is associated with the hammer and acts in conjunction with the ratchet on the end of the cylinder, partially rotates the cylinder to bring a subsequent cartridge in the cylinder into proper firing alignment with the barrel of the pistol. As the hammer approaches its fully cocked position, the actuating member moves beyond and out of contact with the end of the latch member, whereupon the spring means acts on the latch member to return the lug on the end thereof back into engagement with a notch on the cylinder, thereby locking the cylinder in its proper, firing position.

Camming means are provided in combination with the latch member and the actuating member which permits the actuating member to slide past the end portion of the latch member when the trigger is released and the hammer pivots forward from its cocked position to its fired position. The camming means allows the actuating member to slide past the latch member without moving the latch member, and, thus, without retracting the locking lug from the notch in which it is engaged. In a preferred embodiment, the actuating member comprises a spring-loaded pin carried by and being biased so as to project from the hammer, with the pin being adapted to retract into a well in the hammer when a force is applied longitudinally to the free end of the pin to overcome the spring biasing force exerted on the spring-loaded pin. The camming means comprises cooperative surfaces on the free end of the pin and the upper side portion of the end of the latch member, with the camming surfaces being adapted to engage as the hammer pivots from its cocked position to its fired position so that a resultant longitudinal force is applied to the free end of the pin to overcome the spring force on the pin, whereby the pin retracts into the well in the hammer and slides past the portion of the latch member. Advantageously, the hand or pawl is positioned alongside the side of the hammer and is interposed between the hammer and the end portion of the latch member, with the hand being pivotally connected to the hammer by the spring loaded pin which projects outwardly from the hammer through and beyond a pivot opening in the hand. In such an embodiment wherein the hand or pawl is pivotally connected to the hammer by the spring-loaded pin, the pin is adapted to be retractable into the well in the hammer so that the free end of the pin can recede to a position substantially flush with the outside face of the hand, i.e., the side of the hand facing away from the hammer, while the pin still maintains pivotal connection of the hand to the hammer.

Additional objects and features of the invention will become apparent from the following detailed description, taken together with the accompanying drawings.

THE DRAWINGS

A particular embodiment of the present invention representing the best mode presently contemplated of carrying out the invention is illustrated in the accompanying drawings, in which:

FIG. 1 is a perspective view of a small revolver incorporating the cylinder lock mechanism of this invention;

FIG. 2 is a side elevation view of the revolver of FIG. 1, with the side plate removed to show interior components, and with the rocker latch member, which is mounted in a recess in the side plate and on a pivot pin extending from the side plate in the recess, shown in phantom so as to show its working relationship with the other components;

FIG. 3 is a fragmentary side elevation view of the handle and hammer portions of the revolver as in FIG. 2 with the hammer in an intermediate position between the fired position and the fully cocked position, and with the rocker latch member being again shown in phantom;

Figure 5:
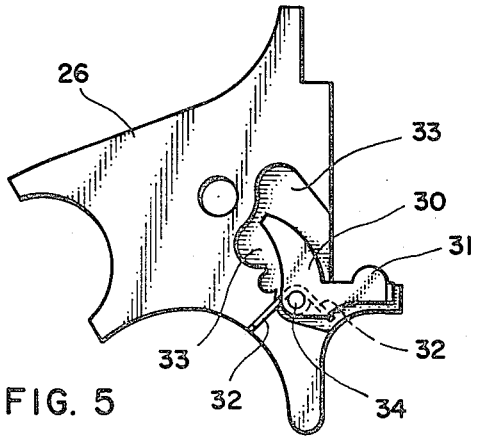
Figure 6:
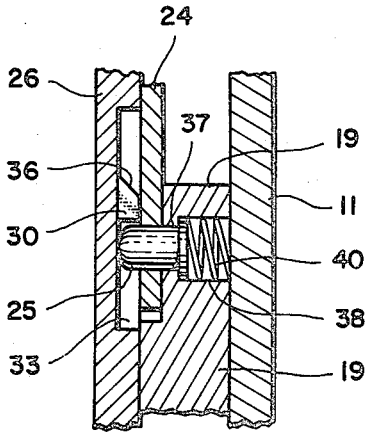
Figure 7:
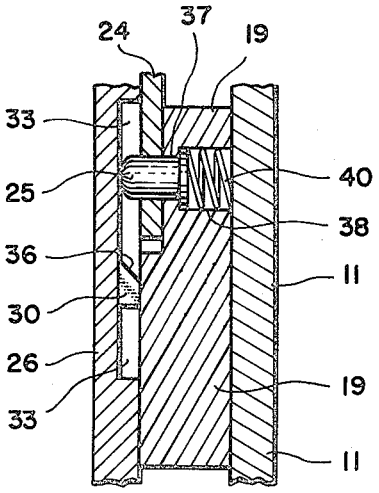

FIG. 5 is a side elevation view of the inside face of the side plate, i.e., the side plate as it is removed from the revolver of FIG. 1 and rotated 180° about a vertical axis; and FIG. 6 is a sectional view taken along the line 6—6 of FIG. 3 and showing the side plate and latch member in their proper operative position, with the hammer being in the fired position; and FIG. 7 is a view similar to that of FIG. 6, with the hammer being in the fully cocked position.

DETAILED DESCRIPTION OF THE PREFERRED EMBODIMENTS

A preferred embodiment of a revolver in accordance with this invention is shown in the drawings, wherein the revolver, shown generally by the numeral 10 has the usual frame 11, with a barrel 12 and a handle 13. The revolver is further of the type comprising a cylinder 14 which is mounted in frame 11 and is held in place by a removable cylinder pin 15 that also serves as an axis about which the cylinder 14 revolves. A trigger 16 is pivotally mounted by a pin 17 to the frame 11, and a spring 18, that is partially recessed in the frame, engages the trigger 16 to bias it to a forward position. A hammer 19 is pivotally mounted to the frame 11 by a pivot pin 20. The hammer includes a thumb projection **19*a* to be used in pivoting the hammer 19 to a cocked position, a striker 19*b* that engages a cartridge placed in the cylinder 14, a notch 19*c* to engage one end of a spring 21, with the other end of the spring 21 being anchored to the bottom portion of the handle 13. A spring engaging finger 19*d* engages spring 21 to deflect it and provide spring tension for a rapid and positive forward pivoting of the hammer 19 during firing of the revolver. A safety notch 19*e* (FIG. 4) and a latch shoulder 19*f* (FIGS. 2 and 3) are provided to be sequentially engaged in a safety position and a fully cocked position, respectively. As is well known in the revolver art, the hand 24 engages radially positioned ratchet cams 35 on the cylinder 14 to partially rotate the cylinder 14 each time the hammer 19 is cocked. Also, as is well known with very small revolvers such as contemplated by the present invention, the hammer 19, trigger 16, and the cylinder rotating means, i.e., the hand or pawl 24 are positioned in a space formed within the frame 11 of the revolver, with a removable cover plate 26** (FIG. 5) provided on one side of the revolver for access to the parts positioned within the space.

The mechanism heretofore described, including the revolver frame, handle, barrel, the removable cylinder pin, the means for operating the cylinder in response to cocking of the hammer, the hammer operating spring and the trigger assembly are all well known in the revolver art and do not, per se, constitute part of the present invention. Similarly, the notches 27 spaced around the cylinder 14 to provide means for locking the cylinder in position as it is sequentially rotated are well known.

In accordance with the present invention, improved cylinder locking means is provided for use in combination with the notches 27 in cylinder 14 for releasably locking the cylinder 14 in its proper aligned position each time the hammer 19 is cocked. The improved cylinder locking means comprises a latch member 30 which is pivotally connected at a position between its ends to the side cover plate 26 (FIG. 5) by a pin 34 extending from the latch member 30. To provide space for the latch member 30 without reducing the size of the hammer 19 and hand 24, a recess 33 (FIGS. 5–7) is formed in the inside face of the cover plate 26. The latch member 30 is of generally shallow "V"-shaped construction, with the base portion of the "V"-shaped latch member 30 being pivotally connected to the cover plate 26 by pin 34.

One end portion of the latch member 30 is positioned adjacent to the lower side of the cylinder 14 and has a locking lug 31 (FIGS. 3 and 5) projecting therefrom which is adapted to make releasable, locking engagement with the notches 27 in the cylinder 14. The other end portion of the latch member 30 extends backwardly and upwardly from the lower end of the cylinder 14 so as to be positioned close to or adjacent to one of the sides of the hammer 19. A coil spring 32 (FIGS. 3–5) is positioned around the pin 34 which pivotally connects the latch member 30 to the cover plate 26, with the one end of the coil spring 32 embedded in a groove in the cover plate 26 and the other end of the spring 32 extending down and engaging the lower portion of the end portion of the latch member 30 which is positioned adjacent to the lower side of the cylinder 14. The spring 32 provides a continuous biasing force on the end of latch member 30 tending to move the locking lug 31 upwardly into engagement with one of the notches 27 in the cylinder 14.

An actuating member is provided which projects outwardly from the hammer and is adapted to (a) strike the underside of the end portion of the latch member which is positioned adjacent to or close to the hammer and pivot the latch member against the force of the spring as the hammer is moved from its fired position to a position between the fired and cocked position, and (b) to escape beyond such end portion of the latch member as the hammer approaches and attains its fully cocked position, whereby the latch member is biased by the spring so that the locking lug on the latch member is moved into engagement with a subsequent notch in the cylinder as the hammer is moved to its fully cocked position.

In the preferred embodiment as illustrated in the drawings, the hammer 19 has a bore 37 (FIGS. 6 and 7) extending therethrough, and a large counterbore 38 (FIGS. 6 and 7) to receive the head of the hand pivot pin 25. The pin 25 extends from the counterbore 38 through the bore 37 and pivotally connects the hand 24 to the hammer 19. A spring 40 (FIGS. 6 and 7) is positioned within the counterbore 38 and is held therein by engagement with the frame 11 when the hammer 19 is pivotally mounted to the frame 11. The pivot pin 25 is adapted for longitudinal, sliding movement through the pivotal bearing opening in the hand 24, so that when a force is applied to the pin 25 sufficient to overcome the biasing force of the spring 40, the pin 25 is retractable into the counterbore 38 through the bore 37. The pin 25 can be retracted to a position wherein its free end is substantially adjacent to the outer surface of the hand 24, i.e., the surface of the hand 24 which is remote from and faces away from the hammer 19. Thus, even in the retracted position, the pin 25 continues to function as the pivotal connection of the hand 24 to the hammer 19. With the hammer 19 in its fired position, the pin 25 is positioned beneath the end portion of the latch member 30 (FIG. 2) and is biased by the spring 40 so that its free end extends beyond the outer surface of the hand 24 (FIG. 6). In this position, the locking lug 31 on the latch member 30 is biased into engagement with one of the notches 27 on the cylinder 14, thereby locking the cylinder 14 against rotation about the cylinder pin 15. As the hammer 19 is pivoted towards its cocked position, the pin 25 engages the blunt underside edge of the end of the latch member 30 adjacent thereto and pivots that end upwardly against the biasing force of coil spring 32 as shown in FIG. 3. The end of the latch member 30 to which the locking lug 31 is attached is pivoted downwardly thus retracting the locking lug 31 from the notch 27 in the cylinder 14. When the locking lug 31 has been disengaged from the notch 27, the cylinder 14 can rotate about the cylinder pin 15.

The revolver is advantageously, and as well known in the art, provided with a safety notch (not shown) on the hammer 19 which engages the trigger during the initial movement of the hammer 19. In the safety position the latch member 30 has not been pivoted sufficiently to withdraw the locking lug 31 from the notch 27 in the cylinder 14, and, thus, the cylinder remains locked against rotation when the revolver is in the safety position.

Figure 4:
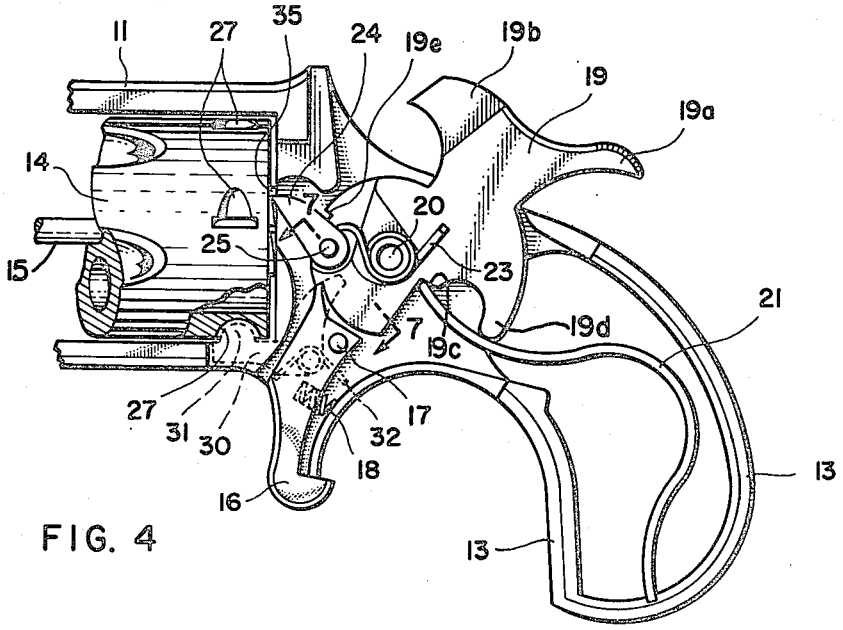
FIG. 4 is a view like that of FIG. 3, but with the hammer in a fully cocked position.

As the hammer is further pivoted towards the cocked position, the pin 25 engages the underside of latch member 30 so as to withdraw the locking lug 31 from the cylinder 14. At the same time, the hand 24 engages the ratchet on the end of the cylinder 14 so as to rotate the cylinder 14 to position a subsequent chamber in the cylinder 14 in proper alignment with the barrel 12. As the cylinder 14 moves into its proper alignment during the final movement of the hammer 19 into its fully cocked position and just before the pivoting hammer reaches its fully cocked position, the pin 25 escapes beyond the end of the latch member 30 as shown in FIGS. 4 and 7, and the latch member 30 is biased by the coil spring 32 so that the locking lug 31 moves into engagement with a corresponding notch 27 in the cylinder 14 to lock the cylinder 14 securely in its proper fixing position.

In the preferred embodiment as illustrated in th drawings, the hand pivot pin 25 acts as both the pivotal connection for the hand 24 to the hammer 19 as well as the actuating means which strikes and pivots the locking latch member 30 during cocking of the hammer. It should be understood, however, that a separate actuating member could be used in combination with the hammer 19 and hand 24 for pivoting the latch member 30. Specifically, a separate retractable pin similar to pin 25 as shown in the drawings but which is not used as the connecting means for the hand 24 could project from the hammer 19 to activate the pivoting of the latch member 30. Its operation in striking the latch member 30 and in being adapted to retract into a springcontaining well in the hammer 19 would be the same as described hereinabove will respect to the hand pivot pin 25.

Camming means is provided in combination with the latch member and the actuating member and is adapted to permit the actuating member to slide past the end of the latch member when the revolver is fired and the hammer 19 is released without pivoting the latch member of retracting the locking lug from its engagement with the notch in the cylinder of the revolver. Preferred camming means as illustrated in the drawings includes cooperating camming surfaces on the pin 25 and the upper side portion of the end of the latch member 30, wherein the camming surfaces are adapted to engage as the hammer 19 pivots from its cocked position to its fired position with a resultant force being applied longitudinally on pin 25 to overcome the spring biasing force of coil spring 40 so that the pin 25 retracts into the hammer and slides past the end of the latch member 30. As illustrated, a camming surface 36 is provided on the upper side of the end portion of the latch member 30 which is adjacent to the hammer 19. The camming surface 36 slopes downwardly from the upper edge of the latch member 30 toward the hammer 19 so that the thickness of the end portion of the latch member 30 is greater at the lower edge of the camming surface 36 than at the upper edge of the end of the latch member 30. The end of pin 25 which engages the camming surface 36 is preferably rounded, and when the hammer 19 moves from its cocked position to its fired position, the spring-biased pin 25 engages the sloped, camming surface 36 on the latch member 30, with the pin 25 being forced to retract into the counterbore 38 in the hammer 19 and to slide past the end portion of the latch member 30. Once the pin 25 has slid past the end of the latch member 30, the biasing force of spring 40 pushes the pin 25 outwardly from the surface of the hand 24 so that it can again strike the underside of the latch member 30 when the hammer 19 is again cocked.

Although a preferred embodiment of the invention which is presently contemplated as the best mode of carrying out the invention has been illustrated and described, it is to be understood that the present disclosure is made by way of example and that variations are possible without departing from the subject matter coming within the scope of the following claims, which subject matter I regard as my invention. For example, the actuating pin 25 need not be spring loaded as described above, i.e., the counterbore 38 and spring 40, although being preferably included in the pistol, are not essential. The pin 25 can be made to extend integrally from the hammer 19, with sufficient play being provided between the hammer 19 and the side plate 11 of the revolver to allow sufficient deflection of the hammer 19 and pin 25 due to the camming action of surface 36 of the latch 30 for the end of pin 25 to escape and slide past the end portion of latch 30 when the pistol is fired, i.e., when the hammer pivots from its cocked position to the fired position.

I claim:

1. In a small, single action revolver of the type comprising a frame including a handle and a barrel, a cylinder having a plurality of cartridge-receiving chambers, said cylinder being rotatably mounted in the frame and having spaced notches formed thereabout, a spring biased hammer mounted to the frame for reciprocal, pivotal movement between fired and cocked positions, means for rotating the cylinder to bring a subsequent chamber in the cylinder into alignment with the barrel when the hammer is pivoted from its fired position to its cocked position, cylinder locking means, which provides for releasably locking the cylinder in its proper aligned position each time the hammer is cocked, and a side cover plate which is attached to the frame and encloses the hammer, trigger, cylinder rotating means, and cylinder locking means in a recess in the frame of the revolver, an improved cylinder locking means comprising:

a rocker latch member being pivotally connected at a position between its ends to the side cover plate, with one end portion of said latch member being positioned adjacent to the lower side of the cylinder and having a locking lug thereon adapted to make releasable, locking engagement with the notches of said cylinder, and with the other end portion of said latch member being positioned close to one of the sides of the hammer;

first spring means acting upon said latch member biasing the locking lug thereon into engagement with said notches in said cylinder;

an actuating member projecting outwardly from the hammer and adapated to: (a) strike the underside of said other end portion of said latch member and pivot the latch member against said spring means to retract said locking lug from the corresponding notch in the cylinder as the hammer is moved from the fired position to a position between the fired and cocked positions, and (b) to escape beyond the free end of said other end portion of said latch member as the hammer attains its fully cocked position; whereby the latch member is biased by said first spring means to move into engagement with a subsequent notch in said cylinder as the hammer is moved to its fully cocked position; and camming means in combination with said latch member and actuating member which is adapted to permit the actuating member, upon firing of the revolver, to slide past the free end of said other end portion of said latch member without pivoting the latch member or retracting the locking lug from the notch in said cylinder as the hammer moves from the cocked position to the fired position.

2. The improved cylinder locking means in accordance with claim 1, wherein said actuating member is a spring-loaded pin carried by and being biased so as to project from the hammer, with said pin being adapted to retract into a well in the hammer when a force is applied to the pin to overcome the spring biasing force exerted on the spring-loaded pin, and wherein said camming means comprises cooperative camming surfaces on said pin and upper side portion of said other end portion of said latch member, said camming surfaces being adapted to engage as the hammer pivots from its cocked position to the fired position so that a resultant force is applied to the spring-loaded pin to overcome the spring force thereon, whereby the pin retracts into the hammer and slides past said other end portion of said latch member as the hammer pivots from its cocked position to its fired position.

3. The improved cylinder locking means in accordance with claim 2, wherein said camming means comprises a camming surface on the upper side of the other end portion of said latch member facing the hammer which slopes downwardly from the upper edge of said other end portion toward the hammer so that the thickness of said other end portion is greater at the lower edge of said camming surface than at said upper edge of said other end portion, whereby when said hammer moves from its cocked position to its fired position, said spring-biased pin engages the sloped, camming surface on the upper side portion of said other end portion of said latch member and is forced to retract into the hammer and to slide past said other end portion of said latch member.

4. The improved cylinder locking means in accordance with claim 1, wherein:

the means for rotating the cylinder when the hammer is pivoted from its fired position to its cocked position includes a hand pivotally connected to one of the sides of the hammer, a ratchet on the cylinder, and second spring means biasing the free end of said hand into engagement with said ratchet;

said other end of the latch member is spaced from said one side of the hammer with the hand being interposed therebetween;

said actuating member is a spring-loaded pin positioned in a well in said one side of said hammer and biased by third spring means in said well so that the pin projects outwardly from said one side of said hammer through and beyond an opening in the hand, with the hand being pivotally connected to the hammer by said pin, and said pin being retractable into said well when a force is applied to the free end of said pin to overcome the spring biasing force exerted on said pin by said third spring means; and said camming means comprises cooperative camming surfaces on said pin and upper side portion of said other end portion of said latch member, said camming surfaces being adapted to engage as the hammer pivots from its cocked position to the fired position so that a resultant force is applied to the spring-loaded pin to overcome the spring biasing force thereon, whereby the pin retracts into the hammer and hand and slides past said other end portion of said latch member as the hammer pivots from its cocked position to its fired position.

5. The improved cylinder locking means in accordance with claim 4, wherein said camming means comprises a camming surface on the upper side of the other end portion of said latch member facing the hammer which slopes downwardly from the upper edge of said other end portion toward the hammer so that the thickness of said other end portion is greater at the lower edge of said camming surface than at said upper edge of said other end portion, whereby when said hammer moves from its cocked position to its fired position, said spring-biased pin engages the sloped, camming surface on the upper side portion of said other end portion of said latch member and is forced to retract into the hand and hammer and to slide past said other end portion of said latch member.

6. The improved cylinder locking means in accordance with claim 4, wherein said second spring comprises a coil spring which makes one coil about the pivot axis of the hammer, with one end of said coil spring extending from the coil and terminating in contact with the hand, and with the other end of said coil spring extending from the coil and terminating in an opening in the hammer which is adapted to receive the end portion of said other end of said coil spring.

7. The improved cylinder locking means in accordance with claim 1, wherein a cavity is milled from the side plate of the revolver which faces the hand for reception of the latch member, with the latch member being pivoted about a pivot pin which is riveted to said side plate, and with said first spring means comprising a coil spring in which the coil is positioned around said pivot pin.

8. The improved cylinder locking means in accordance with claim 1, wherein:

the means for rotating the cylinder when the hammer is pivoted from its fired position to its cocked position includes a hand pivotally connected to one of the sides of the hammer, a ratchet on the cylinder, and second spring means biasing the free end of said hand into engagement with said ratchet, said second spring comprising a coil spring which makes one coil about the pivot axis of the hammer, with one end of said coil spring extending from the coil and terminating in contact with the hand, and with the other end of said coil spring extending from the coil and terminating in an opening in the hammer which is adapted to receive the end portion of said other end of said coil spring.

* * * * *